United States Patent [19]

Jaeschke et al.

[11] 4,214,659

[45] Jul. 29, 1980

[54] EMERGENCY MEDICATION PACKAGE

[75] Inventors: Harold R. Jaeschke, Milwaukee; Daniel J. Boyle, Hartland, both of Wis.

[73] Assignee: Champion International Corporation, Stamford, Conn.

[21] Appl. No.: 947,773

[22] Filed: Oct. 2, 1978

[51] Int. Cl.[2] ..... B65D 83/10

[52] U.S. Cl. ..... 206/365; 206/476; 229/27

[58] Field of Search ..... 206/362.2, 362.3, 15.2, 206/15.3, 362.4, 364, 365, 366, 367, 583, 476, 485, 488, 489, 490; 229/27

[56] References Cited

U.S. PATENT DOCUMENTS

| | | | |
|---|---|---|---|
| 2,084,540 | 6/1937 | Smith | 206/365 |
| 2,604,987 | 7/1952 | Kolodny | 206/365 |
| 2,887,215 | 5/1959 | Hutchison | 206/365 |
| 2,955,705 | 10/1960 | Krueger, Sr. et al. | 206/365 |
| 3,059,830 | 10/1962 | Kramer | 206/583 |
| 3,812,957 | 5/1974 | Forbes, Jr. | 206/485 X |
| 3,937,219 | 2/1976 | Karakashian | 206/365 X |

FOREIGN PATENT DOCUMENTS

| | | | |
|---|---|---|---|
| 945136 | 6/1956 | Fed. Rep. of Germany | 206/583 |

*Primary Examiner*—Joseph Man-Fu Moy
*Attorney, Agent, or Firm*—Evelyn M. Sommer

[57] ABSTRACT

A package for emergency medication has a carton or package body made from a folded, one-piece blank. Within the body, extending from one end over part of the length thereof, is a generally tubular partition in which an injector is received, whose hypodermic needle is maintained spaced from the one end by the fact that finger-engaging ears of the injector rest on the free edge of partition which faces the other end. The other end is provided with another partition which extends across the interior of the package body and is provided with a cut-out into which a medication vial extends which is connected with the injector and which is thus held against moving about. A package holding the vial and injector in side-by-side relation is also disclosed.

2 Claims, 5 Drawing Figures

EMERGENCY MEDICATION PACKAGE

BACKGROUND OF THE INVENTION

1. Field of the Invention

This invention relates to an emergency medication package.

In particular, the invention is directed to a package for a syringe to be used for injecting medication under conditions where time is of critical importance.

2. The Prior Art

There is a variety of medical emergencies where the speed at which medication can be administered to a patient is of critical importance. For example, in the event of cardiac arrest the time required for injecting a heart stimulant may literally means the difference between life and death of the patient.

For such applications, emergency medication systems have been developed which contain, in one package, a syringe (injector) and a vial of the medication to be injected with the syringe. For example, U.S. Pat. No. 3,869,062 describes such a system in which the syringe and the vial are accommodated in a carton in side-by-side relationship. The user tears open one end of the carton, allows the syringe and the vial to slide out, then attaches the vial to the syringe and is now ready to perform the injection.

This system drastically reduces the time previously required to prepare the equipment for use. However, it does still require that a connection be established between the vial and the syringe before injection can begin. If, under the pressure of events, this connection is not properly made, injection is impossible and the connection must either be released and properly established or the system be discarded and a new system be readied for use. In either case, valuable time will be lost. Even if the connection is initially correctly made, some time will be lost which may be of critical importance in the race to save the patient's life.

SUMMARY OF THE INVENTION

Accordingly, it is an object of the invention to provide an emergency medication package which constitutes an improvement over the prior art.

More particularly, it is an object of the invention to provide such a package, which is able to accommodate the vial of medication and the injector for the same as a preassembled unit which is ready for use the moment the package is opened.

Another object of the invention is to provide a package of the type in question wherein the preassembled unit composed of vial and injector is safely held in position against damage during storage and transportation.

In keeping with the above objects, and with still others which will become apparent hereafter, one aspect of the invention resides in a package for two coaxially connected components one of which has transverse projections in the vicinity of its juncture with the other, particularly an emergency medication package for a syringe composed of a cylinder having an open end provided with finger-engaging ears and another end provided with a projecting hypodermic needle and a medication-containing vial connected to the open end and slidable into the same for dispensing of the medicine through the needle, the package comprising a generally tubular package body having two spaced ends, a longitudinal partition extending in the body from one towards but short of the other of the ends so that the projections of the one component can rest on an upper edge of the partition which thus arrests the components against movement towards the one end of the body, and a transverse partition extending across the interior of said body in the region of the other end and having a cut-out in which a portion of the other of the components is receivable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
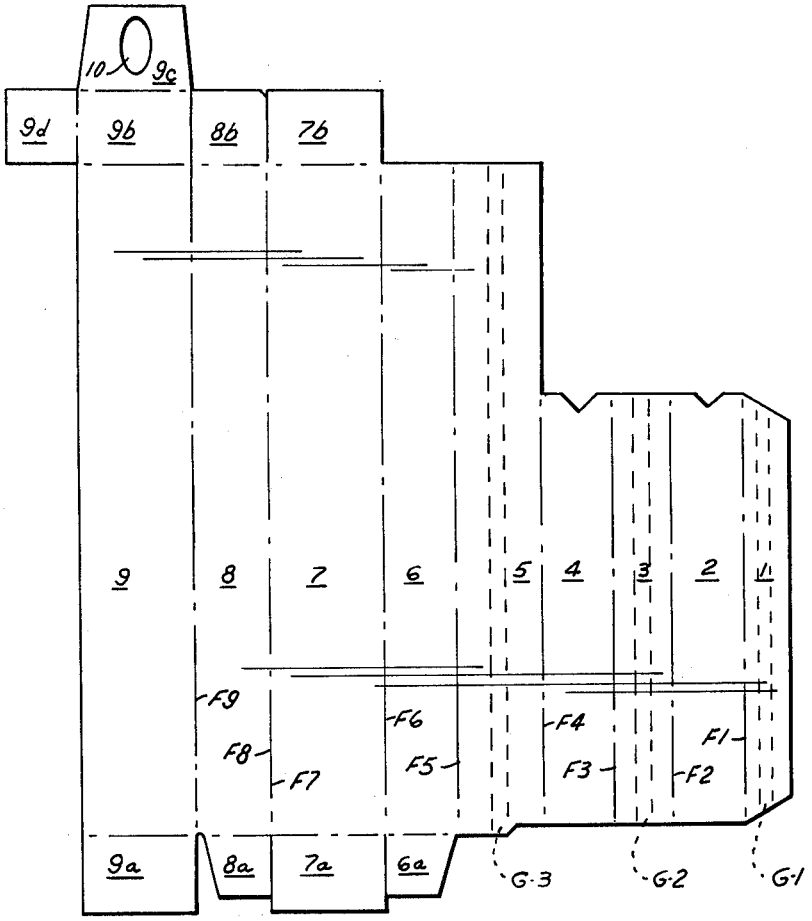
FIG. 1 is a plan view of a blank used to form the package according to the invention.

The improved package according to the invention is made from a one-piece cardboard blank shown in FIG. 1. The blank is produced from cardboard stock of suitable strength by punching, cutting or in any other known manner. It is composed of a plurality of strip-shaped panels 1–9 which are located side-by-side as shown and is provided at the junctions of the respectively adjacent panels with fold lines F1–F9 which are incised, grooved, impressed or otherwise provided so as to facilitate folding of the adjacent panels relative to one another.

Panels 1–4 have a length which is shorter than the length of panels 5–9; the length ratio could be greater or smaller than that which is shown in FIG. 1. Panel 6 has an end flap **6*a* at one end; panels 7 and 8 have end flaps 7*a*, 7*b* and 8*a*, 8*b* at both ends. Panel 9 has an end flap 9*a* at one end and another end flap 9*b* at the other end. A shelf-forming flap 9*c* extends from the free end of flap 9*b* and is provided with a cut-out 10 which may be of any desired outline although it is shown to be oval. A lateral flap 9*d* extends from one side of the end flap 9*b***.

Flaps **7*b* and 8*b* are separated from one another by an incision which extends to the fold line F7; similarly, panels 7 and 8*a* as well as panels 7*a* and 8*a*, are separated from one another by incisions which extend to the fold lines F6 and F7**, respectively.

The phantom lines G1, G2 and G3 on panels 1, 3 and 5 indicate strips on the reverse side of the blank (the one not visible in FIG. 1) to which a suitable adhesive will be applied during assembly of the package.

To convert the blank of FIG. 1 into a package, the panels 1–4 are folded about their respective fold lines F1–F4 until the reverse side of panel 1 comes to lie on the visible side of panel 5, with the free edge of panel 1 abutting the fold line F4. Panel 1 is held in this position by the adhesive applied to strip G1.

Further folding of the panels 5–9 now takes place about the fold lines F5–F9. After panel 6 has been folded about fold line F6 the reverse side of panel 3 will come to rest on the visible side of panel 7 with the fold line F2 up against the fold line F6; panel 5 is held in this position by the adhesive applied to strip G3.

At this time (preferably earlier), the end flap **9*b* is folded down until it rests on the visible side of panel 9; the flaps 8*b* and 9*d* will rest upon the panels 8 and 6, respectively, and the shelf-flap 9*c* will extend across the interior of the package from the flap 9 to or towards the flap 7**.

End flaps **6*a* and 8*a* are folded inwardly towards one another (after the package contents are inserted) and flaps 7*a* and 9*a*** are then folded down and secured to each other in suitable manner by e.g. a spot or strip of adhesive.

Figure 2:
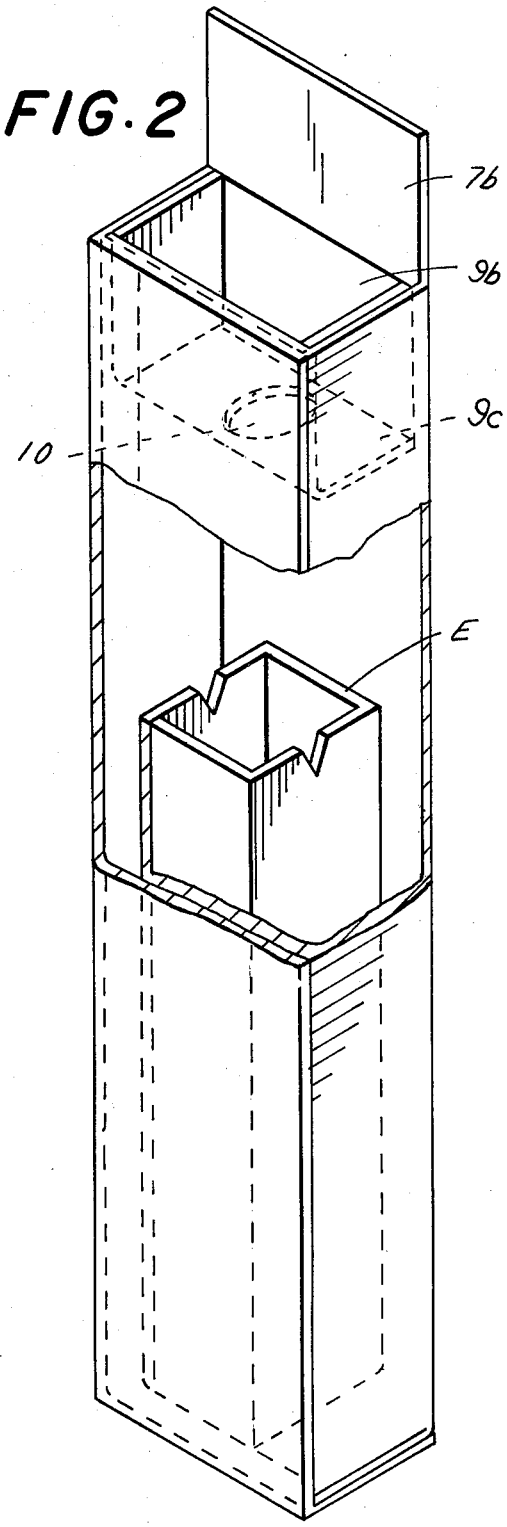
FIG. 2 is a fragmentary perspective view showing the assembled package with one end open to illustrate a detail.

The resulting package has the configuration shown in FIG. 2.

It will be seen from this Figure that the panels 1–4 form in the interior of the package a tubular core which extends from one end over part of the length of the overall package; at the other end, inwardly spaced therefrom, the shelf-flap **9*c* extends across the interior of the package with its cut-out 10 in substantial registry with the free cross-section of the tubular core formed by the panels 1–4**.

Figure 3:
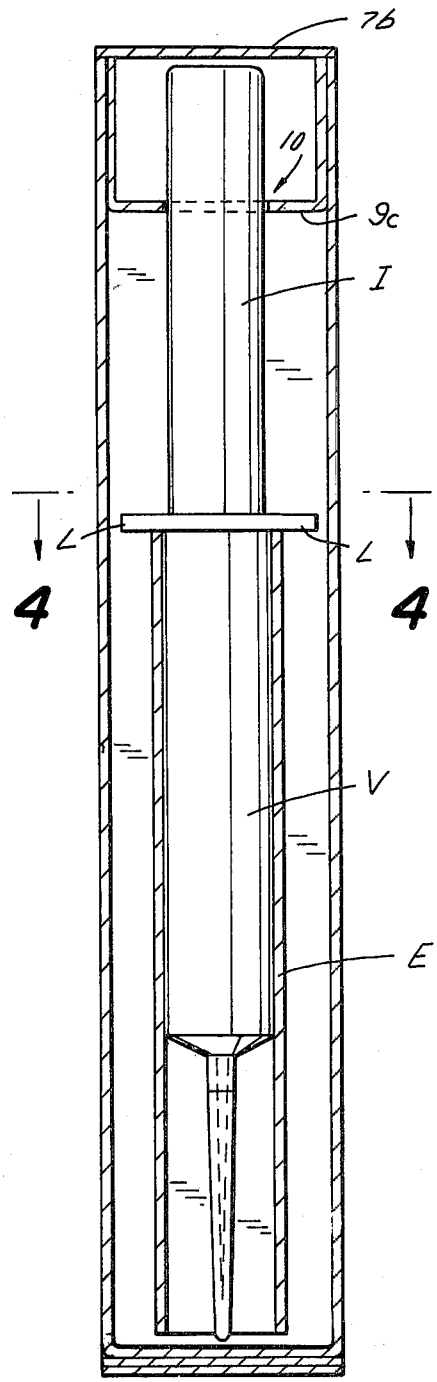
FIG. 3 is a view similar to FIG. 2 but showing the vial-cum-injector unit in place in the package.
Figure 4:
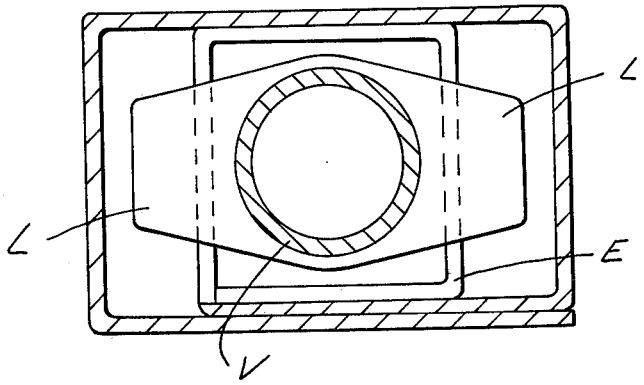
FIG. 4 is a section on line IV—IV of FIG. 3.

This package can now accommodate a preassembled unit composed of a medication vial and an injector for the same, as shown in FIGS. 3 and 4.

The vial V and the injector I (a cylinder having an open end and a closed end with the projecting hypodermic needle) are assembled to one another in the usual manner. It is noted (only peripherally, since it has no bearing on the invention) that the vial V is dimensioned to just fit into the interior of the injector I so that the vial contents are ejected through the needle N of the injector when the lugs or ears 1 of the injector are engaged by two fingers of a user and pressure is exerted upon the free end of the vial V to displace the same into the interior of the injector barrel (i.e. towards the needle N).

When the assembly V-I is installed in the package (FIG. 4) the injector I extends through the interior of the tubular core composed of the panels 1–4 and the lugs L of the injector I come to rest on the upper edge E of the tubular core; this fixes the injector axially against movement and prevents the needle N from penetrating this bottom end. The position of the upper edge E is so chosen that the tip of the needle N is kept about ⅛ inch (could be more but not substantially less) from the bottom end of the package.

The vial V is located in the package space above the tubular core and its free end portion extends through the cut-out 10. Thus, vial V is securely held against movement.

The package may be provided, adjacent the end having the shelf flap **9*c*, with a weakened (e.g. partially perforated) zone along which it will break open when exerted to e.g. thumb pressure, so that the entire end portion of the package (inclusive of the shelf flap 9*c***) can be ripped off in a single movement.

Figure 5:
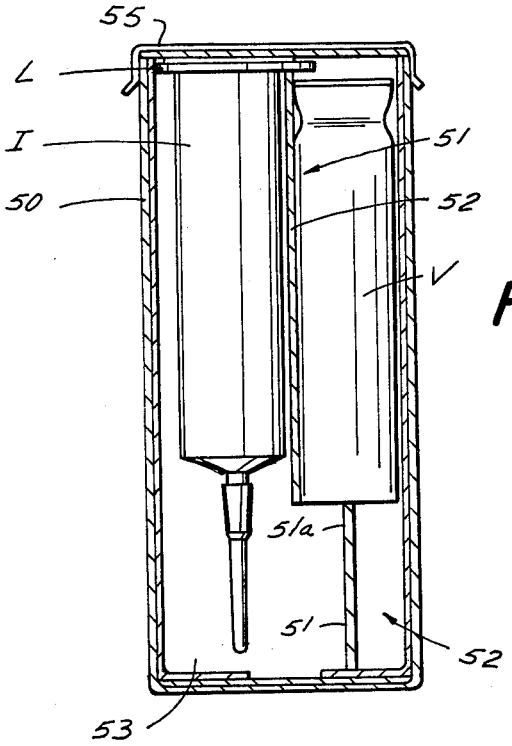
FIG. 5 is a vertical section showing another embodiment.

Of course, should it be desired to have the vial V and the injector I in the package in side-by-side relation—e.g. for applications where the time required is not of such crucial importance—then the package could be constructed in the manner shown in FIG. 5.

The package body 50 could again be assembled from a one-piece blank of e.g. cardboard. Here, however, the partition 51 (which could be of one piece with the remainder of the blank or be a separate member suitably connected to the blank, as by gluing), would have the purpose of subdividing the interior of the body into two side-by-side compartments 52 and 53 adapted to receive the vial V and the injector I, respectively. A portion **51*a* of the partition 51 would serve to prevent axial movement of the vial V in the package body, whereas the upper edge 54 of the other portion 52*c* of the partition would have one of the lugs L of the injector I resting on it to fix the injector in position in cooperation with the end flap 55** of the package body.

While the invention has been illustrated and described as embodied in an emergency medication package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An emergency medication package for a hypodermic syringe composed of a cylinder having an open end provided with finger engaging ears and another end provided with a projecting needle and a medication vial connected to the open end and slidable into same for dispensing of the medicine through the needle, said package being formed from a one piece foldable cardboard blank and comprising a generally tubular package body having upper and lower spaced ends; a longitudinal partition dimensioned to receive the cylinder therewithin, said longitudinal partition extending within said package body from said lower end towards but short of said upper end and wherein the distance from the upper edge of said longitudinal partition to the lower end of said package body is greater than the total length of said cylinder and said needle such that the finger engaging ears of the cylinder rests on the upper edge of said longitudinal partition, which thus spaces the needle from the lower end of the package body and arrests the syringe against movement towards the lower end, thereby reducing the likelihood of breakage of the syringe, said longitudinal partition comprising a plurality of sidewalls hingedly joined together by fold lines in said blank and forming a tubular structure within said tubular package body which circumscribes said cylinder, at least one of said side walls being hingedly connected by a fold line to said tubular package body; and a transverse partition extending across the interior of said package body in the region of said upper end and having a cut out in which a portion of the vial is receivable, said transverse partition comprising a flap member hingedly connected by a fold line in said blank to said tubular package body.

2. A package as defined in claim 1, wherein said cut-out is of oval outline.

* * * * *